US008577072B2

(12) United States Patent
Watanabe et al.

(10) Patent No.: US 8,577,072 B2
(45) Date of Patent: Nov. 5, 2013

(54) ELECTRONIC DEVICE

(75) Inventors: Kiyoshi Watanabe, Ome (JP); Maki Maeda, Mitaka (JP)

(73) Assignee: Casio Computer Co., Ltd., Tokyo (JP)

( * ) Notice: Subject to any disclaimer, the term of this patent is extended or adjusted under 35 U.S.C. 154(b) by 62 days.

(21) Appl. No.: 13/299,525

(22) Filed: Nov. 18, 2011

(65) Prior Publication Data

US 2012/0128196 A1 May 24, 2012

(30) Foreign Application Priority Data

Nov. 24, 2010 (JP) ..... 2010-261018

(51) Int. Cl.
*H04R 1/02* (2006.01)

(52) U.S. Cl.
USPC ..... 381/386; 381/365; 381/87; 200/512

(58) Field of Classification Search
USPC ..... 381/58, 59, 86, 333, 365, 386, 388, 87; 361/679.01, 679.55, 807, 288; 345/169; 200/5 R, 512; 455/575.1
See application file for complete search history.

(56) References Cited

U.S. PATENT DOCUMENTS

| | | | | |
|---|---|---|---|---|
| 6,717,074 | B2 * | 4/2004 | Lu | 200/5 R |
| 6,933,927 | B2 * | 8/2005 | Lu | 345/169 |
| 7,069,061 | B2 * | 6/2006 | Gammon et al. | 455/575.1 |

FOREIGN PATENT DOCUMENTS

| | | | |
|---|---|---|---|
| JP | 59-084731 | U | 6/1984 |
| JP | 06-268548 | A | 9/1994 |
| JP | 2002-209003 | A | 7/2002 |
| JP | 2005-236894 | A | 9/2005 |
| JP | 2008-159026 | A | 7/2008 |

OTHER PUBLICATIONS

Japanese Office Action dated Nov. 16, 2012 (and English translation thereof) in counterpart Japanese Application No. 2010-261018.

* cited by examiner

*Primary Examiner* — Curtis Kuntz
*Assistant Examiner* — Joshua Kaufman
(74) *Attorney, Agent, or Firm* — Holtz, Holtz, Goodman & Chick, PC

(57) ABSTRACT

In an electronic device, a speaker attaching section 17 which is vertically open with respect to a circuit board 10 and into which a speaker 16 is press-fitted is integrally formed on a contact sheet 13 arranged on the circuit board 10 provided inside an upper case 8. Therefore, the speaker 16 can be easily attached in a manner that sound therefrom does not leak, simply by the speaker 16 being press-fitted into the speaker attaching section 17 of the contact sheet 13. Accordingly, in the present invention, the structure of the speaker section 6 is simple and the number of its components is small, whereby the thickness of the speaker section 6 can be reduced. In addition, sound generated by the speaker can be favorably and reliably emitted from the speaker attaching section 17 to the outside of the upper case 8, without chattering noise being generated.

7 Claims, 15 Drawing Sheets

ELECTRONIC DEVICE

CROSS-REFERENCE TO RELATED APPLICATION

This application is based upon and claims the benefit of priority from the prior Japanese Patent Application No. 2010-261018, filed Nov. 24, 2010, the entire contents of which is incorporated herein by reference.

BACKGROUND OF THE INVENTION

1. Field of the Invention

The present invention relates to an electronic device including a speaker, such as an electronic dictionary, a mobile phone, or a personal digital assistant (PDA).

2. Description of the Related Art

As a mounting structure for a speaker in a mobile phone, a structure is known in which a speaker unit is provided on a circuit board inside a device case, a contact sheet having a plurality of contact sections is provided on the circuit board, a key sheet having a plurality of key tops is provided on the contact sheet and each key top of the key sheet is exposed from the surface of the device case, as described in Japanese Patent Application Laid-Open (Kokai) Publication No. 2005-236894.

In amounting structure for a speaker such as this, a sound emitting hole is provided in a key top of the key sheet in an area corresponding to the speaker unit, as well as in a contact section of the contact sheet in the area corresponding to the speaker unit, in order to emit sound generated in the speaker unit from the device case.

However, there is a problem in this conventional mounting structure for a speaker in that the thickness from the front surface of the key top to the undersurface of the speaker unit is large and therefore the thinning of the device cannot be achieved.

In addition, there is another problem in this conventional mounting structure for a speaker in that sound generated in the speaker unit cannot be satisfactorily emitted outside from the device case.

Although a mounting structure has been developed in which the contact sheet between the speaker unit and the key sheet is arranged underneath the speaker unit, and the speaker unit is placed closer to the key tops of the key sheet, there is a problem in that sound generated in the speaker unit is not emitted from only the sound emitting hole in the key top because it leaks to the surrounding area of the speaker unit.

As described above, in the conventional mounting structure for a speaker, a structure has been adopted in which a speaker unit is provided on a circuit board. Accordingly, the contact sheet is required to be provided on or underneath the speaker unit, and therefore the overall thickness cannot be made sufficiently thin.

SUMMARY OF THE INVENTION

An object of the present invention is to provide an electronic device having a mounting structure for a speaker which is simple and by which the thinning of the device can be achieved and sound generated by the speaker can be satisfactorily emitted outside the device case.

In order to achieve the above-described object, in accordance with one aspect of the present invention, there is provided an electronic device comprising: a case in which an opening section is provided in a predetermined area; a circuit board arranged inside the case; a speaker electrically connected to the circuit board; and a contact sheet arranged on the circuit board, in which a speaker attaching section, which is vertically open with respect to the circuit board and into which the speaker is press-fitted, is integrally formed in an area corresponding to the opening section in the case.

In the present invention, the speaker can be easily attached by simply being fitted in the speaker attaching section provided on the contact sheet arranged on the circuit board inside the case. Accordingly, the structure is simple and the number of its components is small, whereby the thickness of the device can be reduced. In addition, sound generated by the speaker can be favorably emitted outside the case without chattering noise being generated.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

An embodiment in which the present invention has been applied to an electronic dictionary will hereinafter be described with reference to FIG. 1 to FIG. 15.

Figure 1:
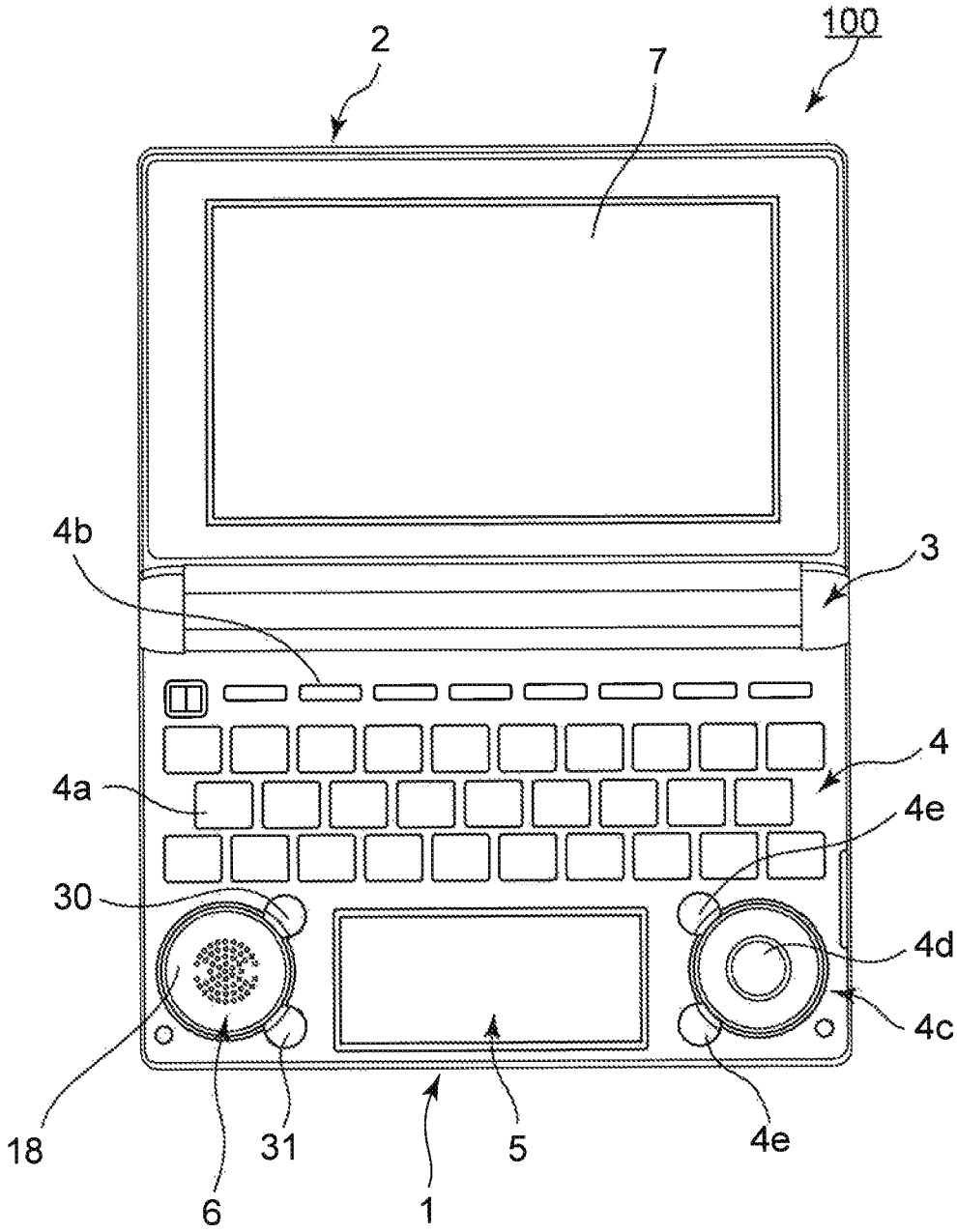
FIG. 1 is an outer appearance view of an electronic dictionary to which the present invention has been applied.

As shown in FIG. 1, an electronic dictionary 100 is structured such that a first case 1 and a second case 2 are openably and closably connected by a hinge section 3.

The first case 1 includes a key input section 4, a touch input section 5, and a speaker section 6, and the second case 2 includes a display section 7. The display section 7 is constituted by a flat display panel such as a liquid crystal display panel or an electroluminescent (EL) display panel, and electro-optically displays various information required for a dictionary function.

The key input section 4 includes various keys required for the dictionary function, such as character keys 4*a*, function keys 4*b*, and a cursor key 4*c*. In this instance, an enter key 4*d* is provided in the center of the cursor key 4*c*, and two auxiliary keys 4*e* are provided around the outer periphery of the cursor key 4*c*.

The touch input section 5 is a display panel layered on the undersurface of a transparent touch panel. The speaker section 6 is used to put out information displayed in the display section 7 by sound, which has a switch function described hereafter.

Figure 3:
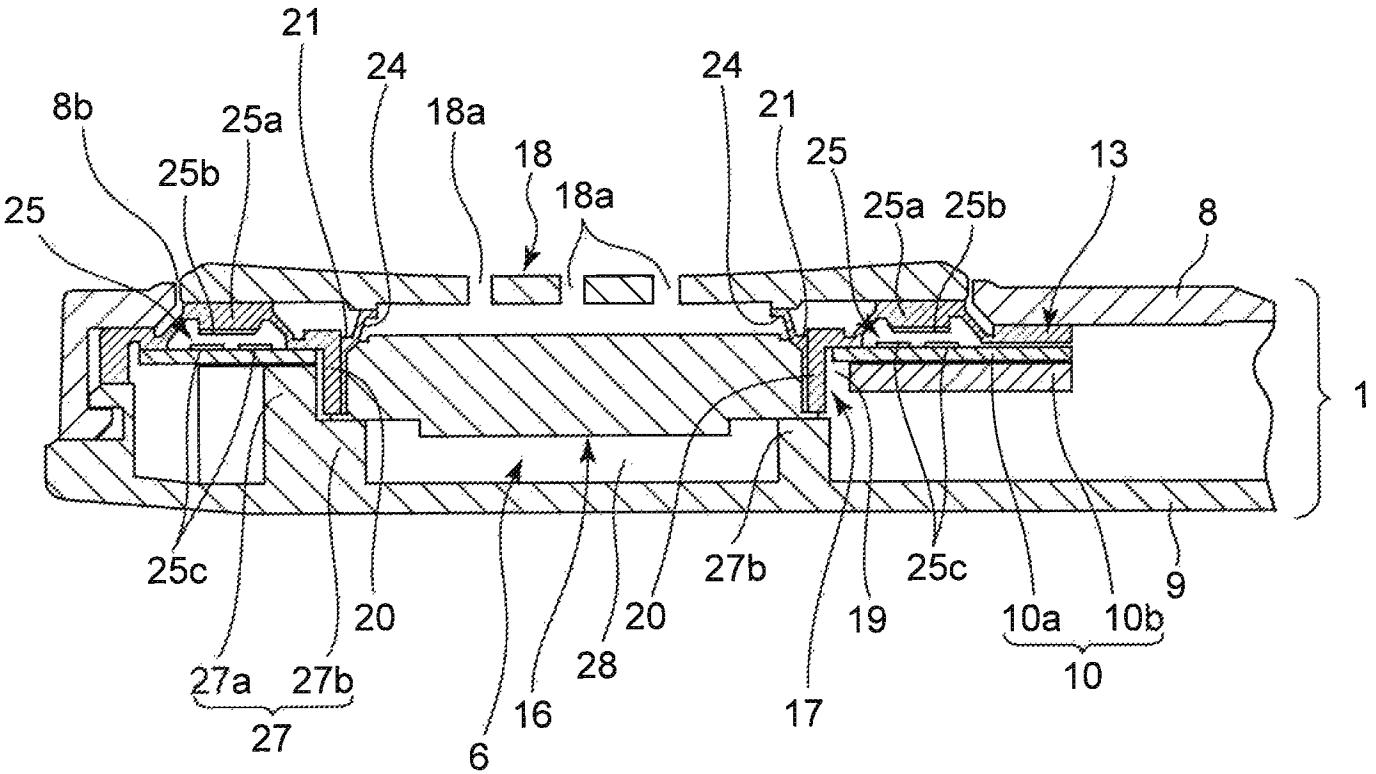
FIG. 3 is an enlarged cross-sectional view of the speaker section taken along line A-A in FIG. 2.

The first case 1 includes an upper case 8 and a lower case 9 as shown in FIG. 3, and a circuit board 10 is arranged over substantially the entire area inside the upper case 8 and the lower case 9. The circuit board 10 has a two-layer structure in which an upper substrate 10*a* and a lower substrate 10*b* are layered, as shown in FIG. 3 and FIG. 4. On the top surface of the upper substrate 10*a*, a plurality of fixed contacts 11*a* are provided respectively corresponding to the keys 4*a* to 4*e* of the key input section 4 excluding the cursor key 4*c*, as shown in FIG. 4A.

Figure 4A:
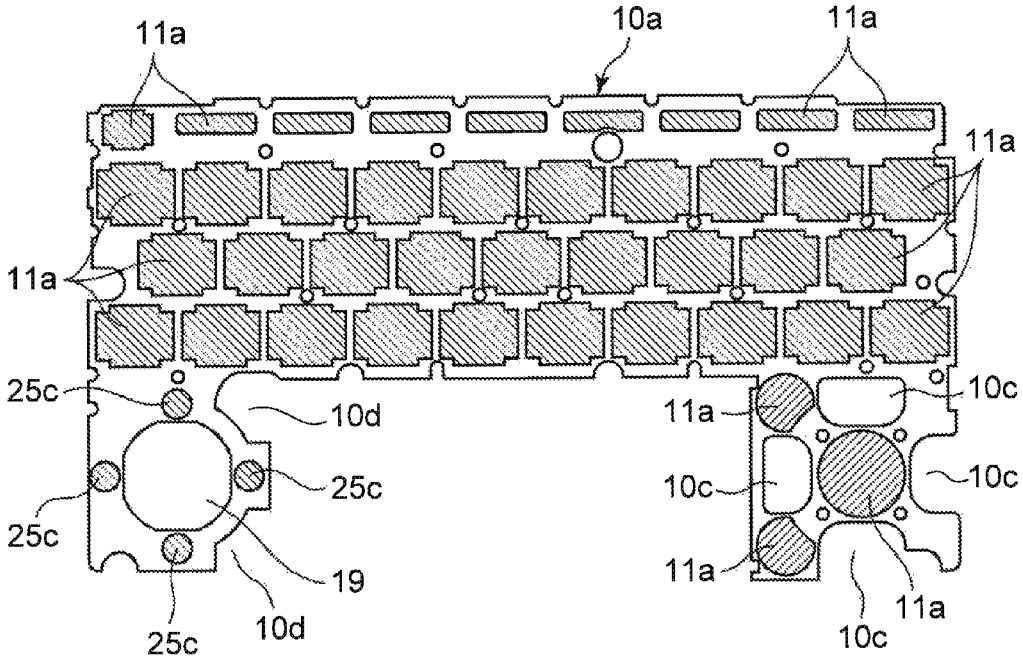
FIG. 4A is a planar view showing an upper substrate of a circuit board of the electronic dictionary.
Figure 4B:
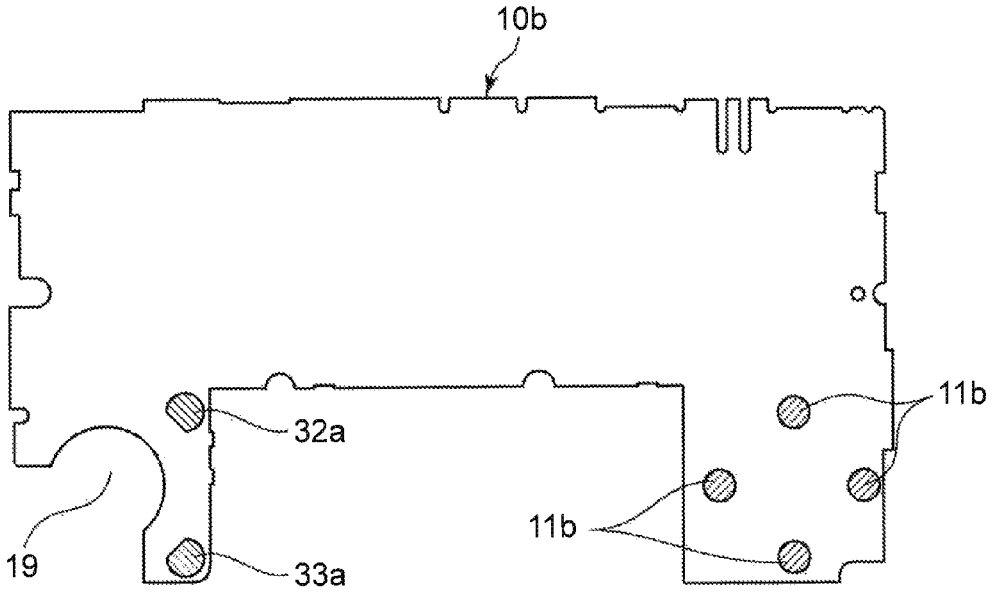
FIG. 4B is a planar view showing a lower substrate of the circuit board of the electronic dictionary.
Figure 6:
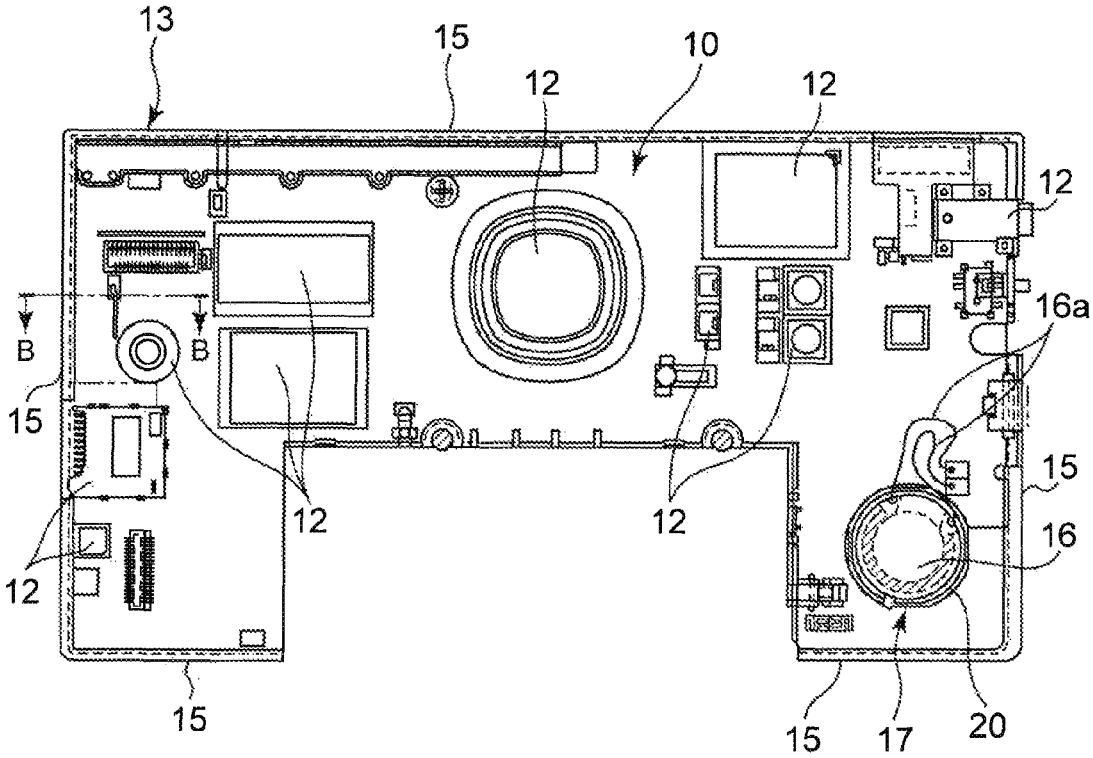
FIG. 6 is a rear view of the circuit board to which the contact sheet has been attached, when viewed from below.

Also, on the top surface of the lower substrate 10*b*, fixed contacts 11*b* corresponding to the cursor key 4*c* is provided corresponding to contact insertion holes 10*c* in the upper substrate 10*a* of FIG. 4A, as shown in FIG. 4B. As shown in FIG. 6, various electronic components 12 required for the dictionary function are mounted on the undersurface of the circuit board 10, or in other words, the undersurface of the lower substrate 10*b*.

Figure 5:
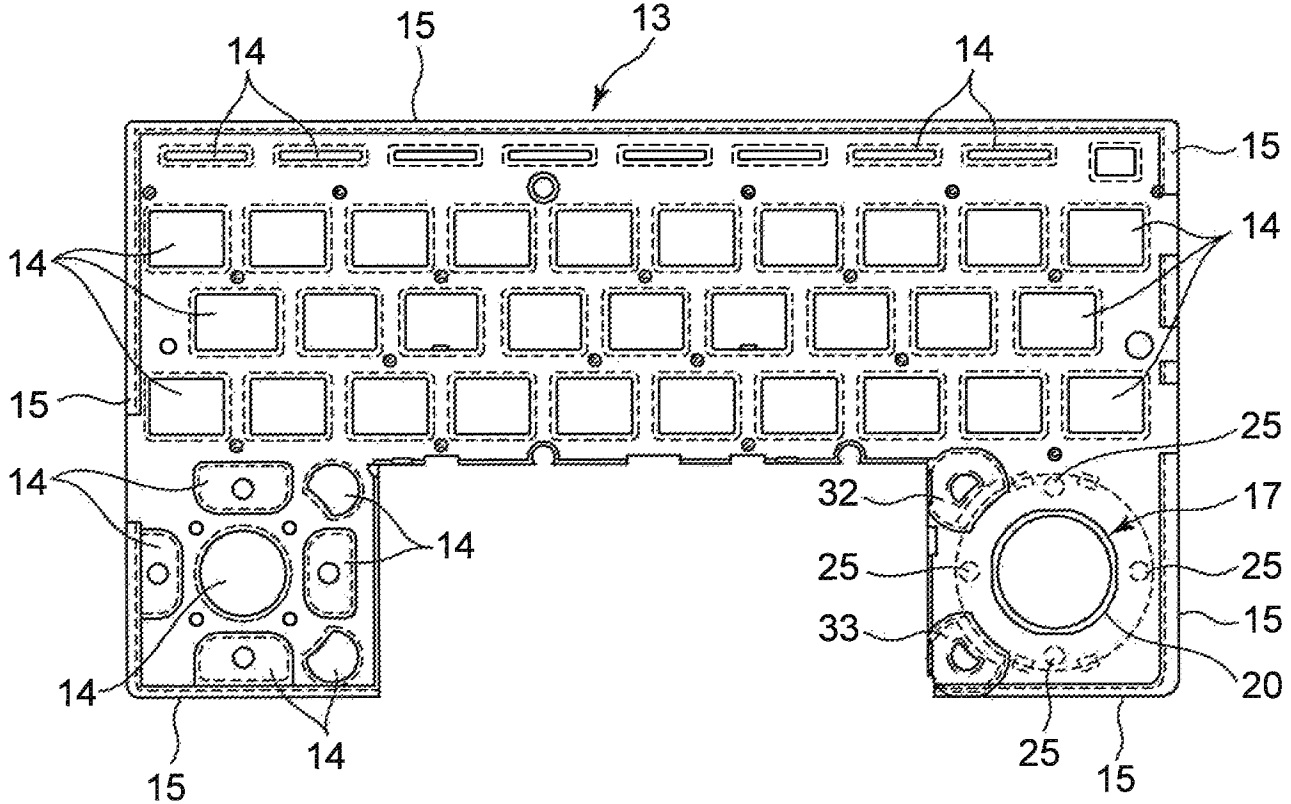
FIG. 5 is a planar view showing a contact sheet of the electronic dictionary.
Figure 10:
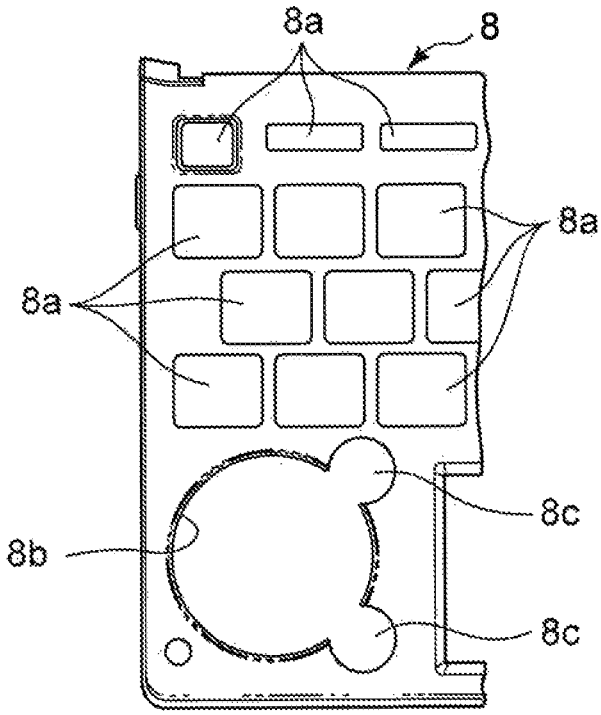
FIG. 10 is an enlarged planar view of the speaker section in an upper case of the electronic dictionary.

In addition, a contact sheet 13 made of an elastic material, such as rubber or elastomer, is arranged on the top surface of the circuit board 10, or in other words, on the top surface of the upper substrate 10*a*, as shown in FIG. 3. On the contact sheet 13, a plurality of contact sections 14 are integrally provided respectively corresponding to the keys 4*a* to 4*e* of the key input section 4, as shown in FIG. 5. The upper case 8 is provided with key insertion holes 8*a* into which the keys 4*a* to 4*e* are respectively inserted, as shown in FIG. 10.

Figure 7:
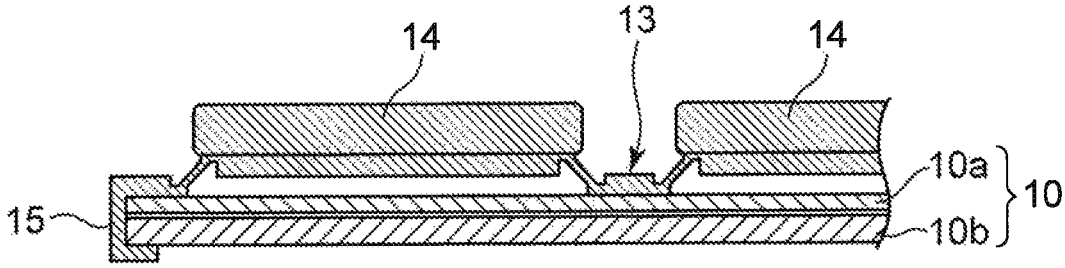
FIG. 7 is an enlarged cross-sectional view taken along line B-B in FIG. 6.

As shown in FIG. 5 to FIG. 7, a gripping section 15 that grips the outer peripheral edge of the circuit board 10 is provided on the outer peripheral edge of the contact sheet 13. The gripping section 15 is formed into a groove shape that extends from the top surface of the circuit board 10 to the side surface and further to the undersurface along the outer peripheral edge thereof, as shown in FIG. 7. As a result, the gripping section 15 is structured such that the contact sheet 13 is attached to the circuit board 10 by the contact sheet 13 being placed on the circuit board 10 and the outer peripheral edge of the circuit board 10 being fitted in the gripping section 15, as shown in FIG. 6 and FIG. 7.

Figure 2:
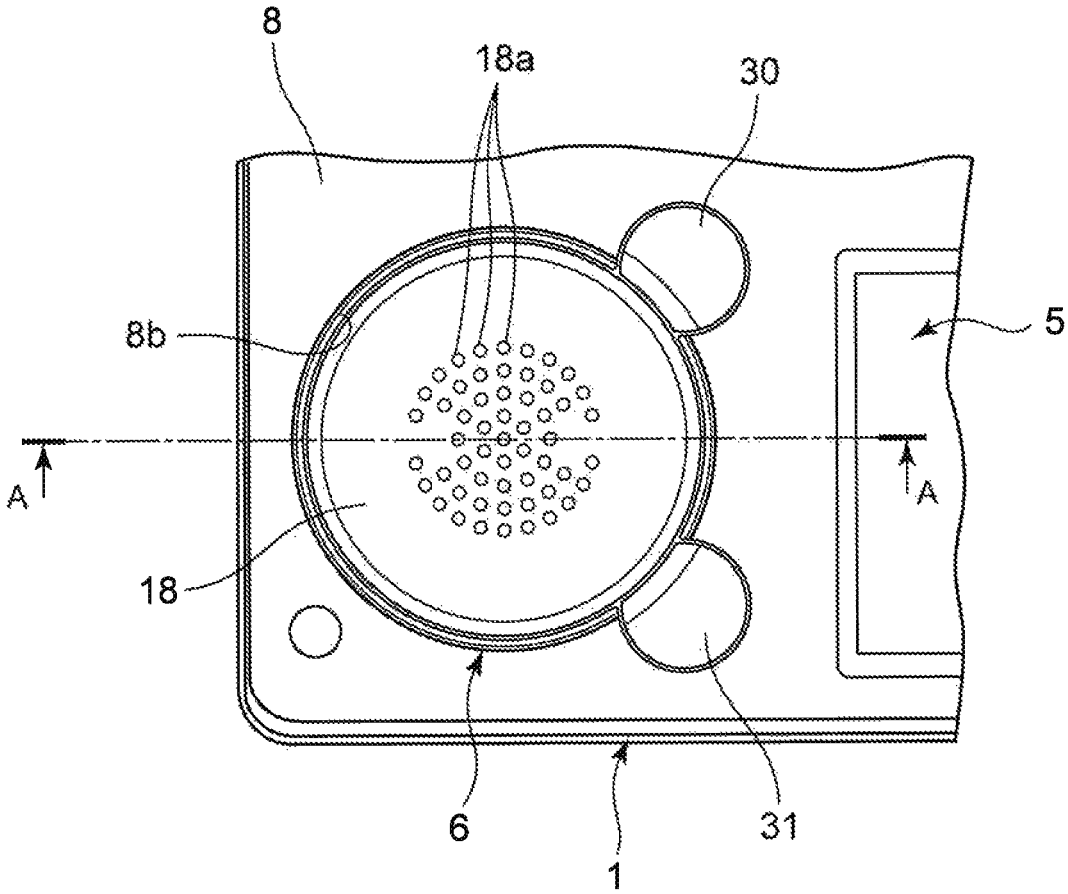
FIG. 2 is an enlarged planar view showing a speaker section of the electronic dictionary shown in FIG. 1.

The speaker section 6 includes the circuit board 10 arranged inside the first case 1, a disk-shaped speaker electrically connected to the circuit board 10 by a lead wire 16*a*, the contact sheet 13 on which a speaker attaching section 17 where the speaker 16 is attached is integrally formed, and the key top 18 arranged on the speaker attaching section 17 of the contact sheet 13, as shown in FIG. 2 and FIG. 3.

As shown in FIG. 3, FIG. 4, and FIG. 6, an insertion hole 19 into which the speaker attaching section 17 of the contact sheet 13 is inserted is provided in the circuit board 10. The speaker attaching section 17 includes a cylindrical section 20 that projects lower than the circuit board 10 from the undersurface of the contact sheet 13 through the insertion hole 19 in the circuit board 10, and a stopper section 21 that projects inward to form a brim-like shape from the upper portion of the cylindrical section 20, as shown in FIG. 3.

Figure 9:
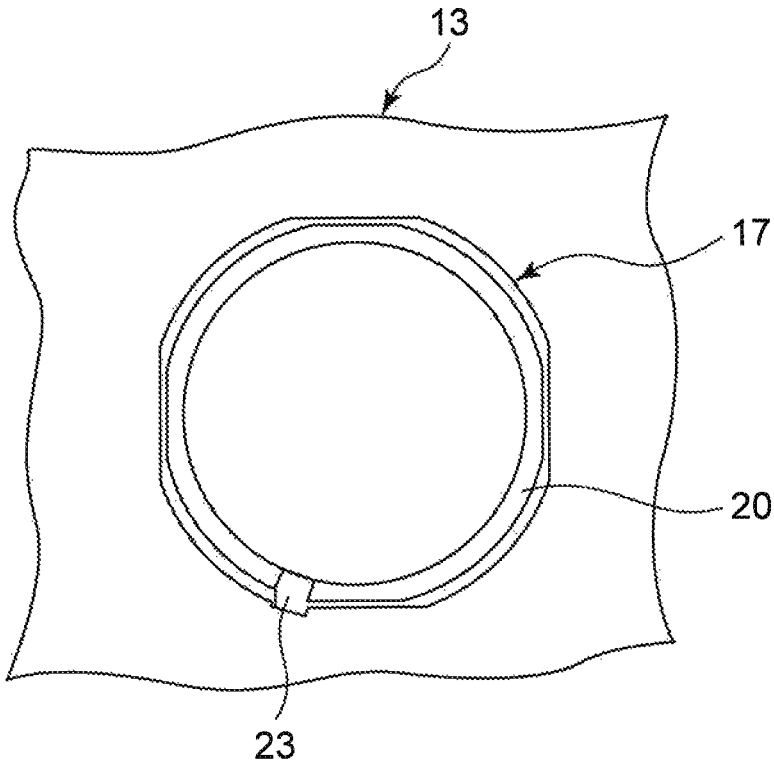
FIG. 9 is an enlarged rear view of the main section of a speaker attaching section on the contact sheet into which the speaker shown in FIG. 8 is attached.
Figure 14:
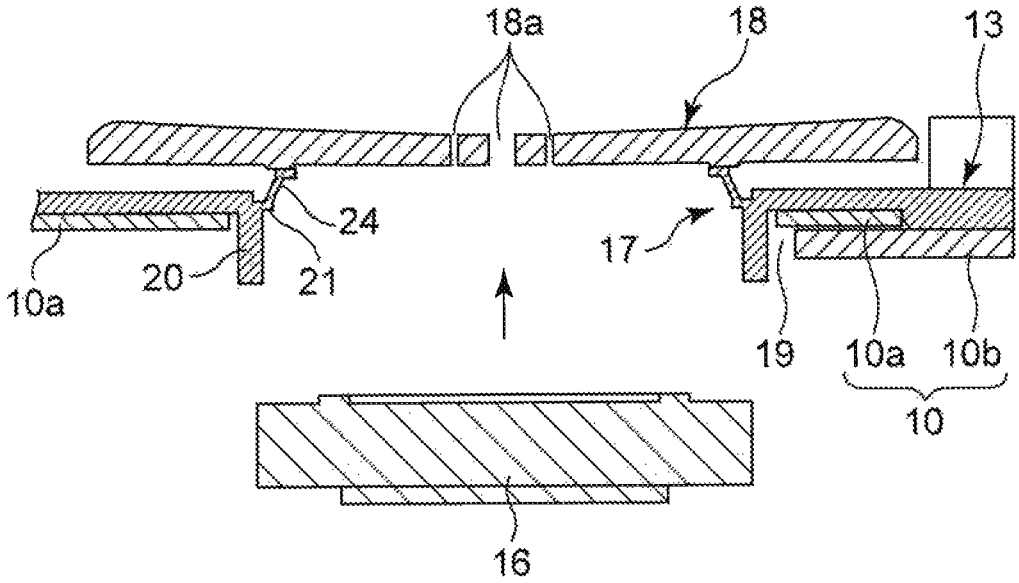
FIG. 14 is an enlarged cross-sectional view showing a state where the speaker is inserted into the speaker attaching section on the contact sheet.

The cylindrical section 20 of the speaker attaching section 17 is a circular cylinder section whose top and bottom are open as shown in FIG. 3, FIG. 9, and FIG. 14, and formed having an inner diameter that is slightly smaller than the outer diameter of the speaker 16, and a height that is almost the same as the thickness of the speaker 16. Accordingly, the speaker 16 is fitted in this cylindrical section 20 by being pressed from below.

Figure 15:
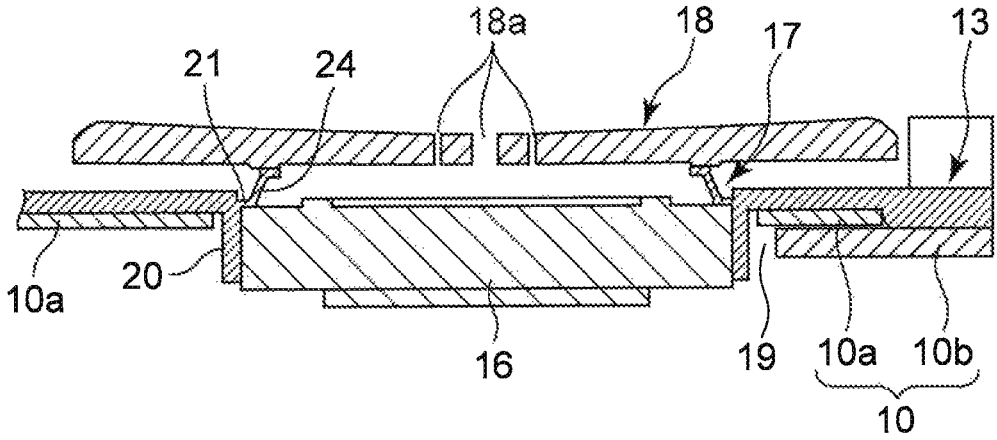
FIG. 15 is an enlarged cross-sectional view showing a state where the speaker has been fitted in the speaker attaching section.

That is, the cylindrical section 20 is structured such that, when the speaker 16 is fitted therein, the speaker 16 is attached without a gap being formed that causes sound from the speaker 16 to leak, as shown in FIG. 3 and FIG. 15. In addition, the stopper section 21 is structured such that, when the speaker 16 is fitted in the cylindrical section 20 by being pressed from below, the stopper section 21 comes in contact with the upper surface of the outer periphery of the speaker 16, and thereby restricts the upper limit position of the speaker 16 and fixes the speaker 16 inside the cylindrical section 20.

Figure 8:
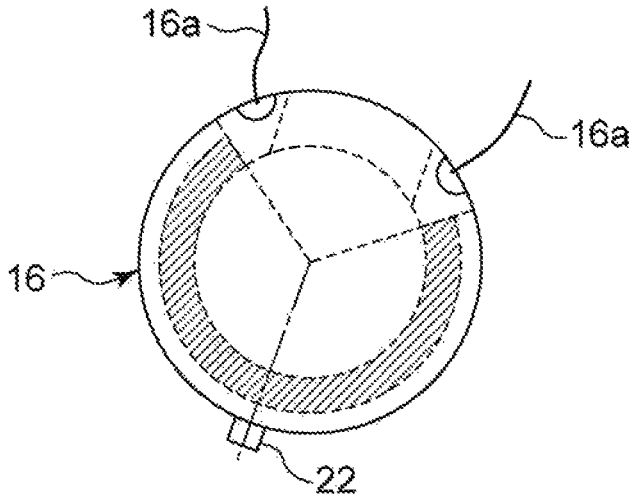
FIG. 8 is an enlarged planar view of a speaker shown in FIG. 6.

As shown in FIG. 8, an engaging projection 22 for positioning is provided on the outer periphery of the speaker 16. In addition, as shown in FIG. 9, an engaging groove section 23 for positioning, with which the engaging projection 22 of the speaker 16 engages, is provided in the cylindrical section 20 of the speaker attaching section 17. As a result, when the speaker 16 is fitted in the cylindrical section 20 by being pressed from below, the engaging projection 22 of the speaker 16 engages with the engaging groove section 23 of the cylindrical section 20, whereby the rotation position of the speaker 16 in the planar direction is restricted.

Figure 11:
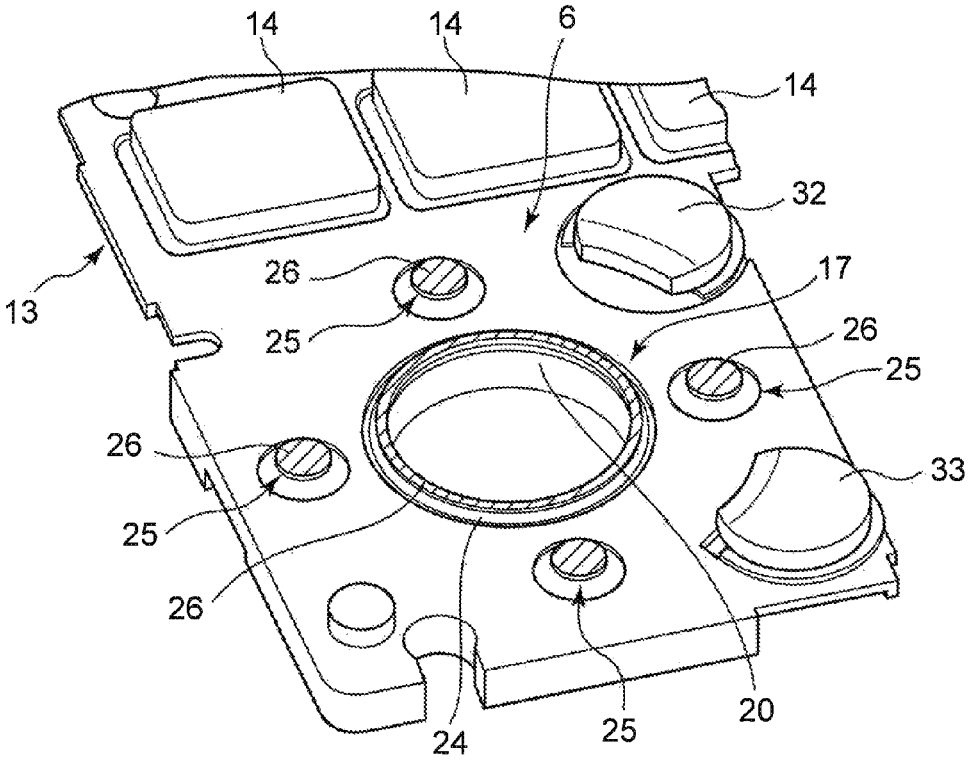
FIG. 11 is an enlarged perspective view of the speaker section on the contact sheet.

Moreover, as shown in FIG. 3 and FIG. 11, a skirt section 24 that is elastically deformable and extends higher than the contact sheet 13 is integrally formed on the inner periphery of the stopper section 21 in the speaker attaching section 17, and surrounds the upper periphery of the speaker 16. The upper portion of the skirt section 24 is open, and the key top 18 is arranged on the peripheral edge of this open upper portion. As a result of this structure, the skirt section 24 holds the key top 18 so as to elastically press the key top 18 upwards, and surrounds the upper periphery of the speaker 16 such that sound from the speaker 16 does not leak to the surrounding area.

Furthermore, as shown in FIG. 3, FIG. 5, and FIG. 11, a plurality of contact sections 25 are provided on the contact sheet 13 along the outer periphery of the speaker attaching section 17. These contact sections 25 are respectively provided in the 12 o'clock, 3 o'clock, 6 o'clock, and 9 o'clock positions in the outer periphery of the speaker attaching section 17.

Each contact section 25 includes a dome-shaped protruding section 25*a* formed slightly higher than the skirt section 24 of the speaker attaching section 17, a movable contact 25*b* provided inside the protruding section 25*a*, and a fixed contact 25*c* provided on the upper substrate 10*a* of the circuit board 10 to come in contact with the movable contact 25*b*, as shown in FIG. 3.

Accordingly, the plurality of contact sections 25 each form a key switch. For example, the contact section 25 at the 12 o'clock position is a key switch for switching the mode of the electronic dictionary 100 to a history mode, the contact section 25 at the 3 o' clock position is a key switch for setting a display layout, the contact section 25 at the 6 o'clock position is a key switch for setting a jump mode, and the contact section 25 at the 9 o'clock position is a key switch for selectively specifying text size.

The key top 18 is formed into a disk shape of a size covering the plurality of contact sections 25 arrayed in a ring shape, and arranged on the upper portion of the speaker attaching section 17, as shown in FIG. 3. This key top 18 is arranged within a circular hole 8*b* provided in the upper case 8 as shown in FIG. 10, and is exposed from the upper side of the upper case 8 as shown in FIG. 2.

Figure 12:
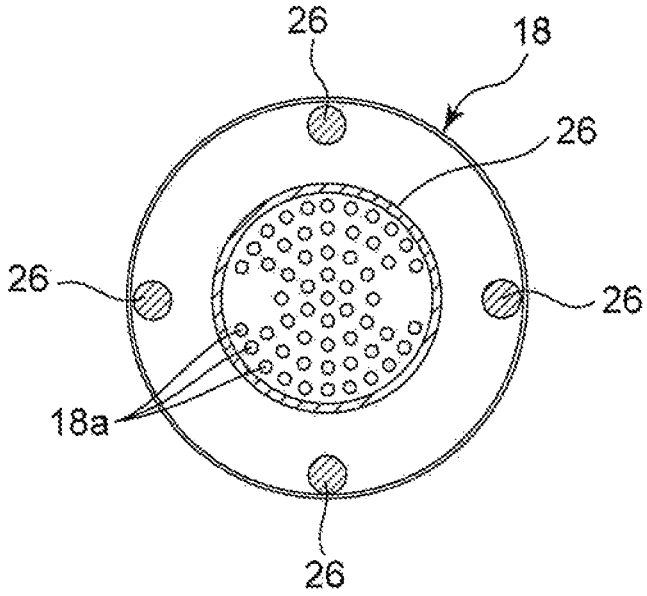
FIG. 12 is an enlarged rear view of a key top shown in FIG. 2.

Also, the key top 18 is bonded to the outer peripheral edge of the upper portion of the skirt section 24 of the speaker attaching section 17 and the top surface of each contact point 25 by adhesive glue 26, as shown in FIG. 11 and FIG. 12. In the center portion of this key top 18 corresponding to the speaker attaching section 17, a plurality of sound emitting holes 18*a* are provided as shown in FIG. 2 and FIG. 3. As a result, a closed space is formed between the key top 18 and the speaker 16 by the skirt section 24 of the speaker attaching section 17, whereby sound from the speaker 16 is prevented from leaking from an area other than the sound emitting holes 18*a*, as shown in FIG. 3 and FIG. 15.

Figure 13:
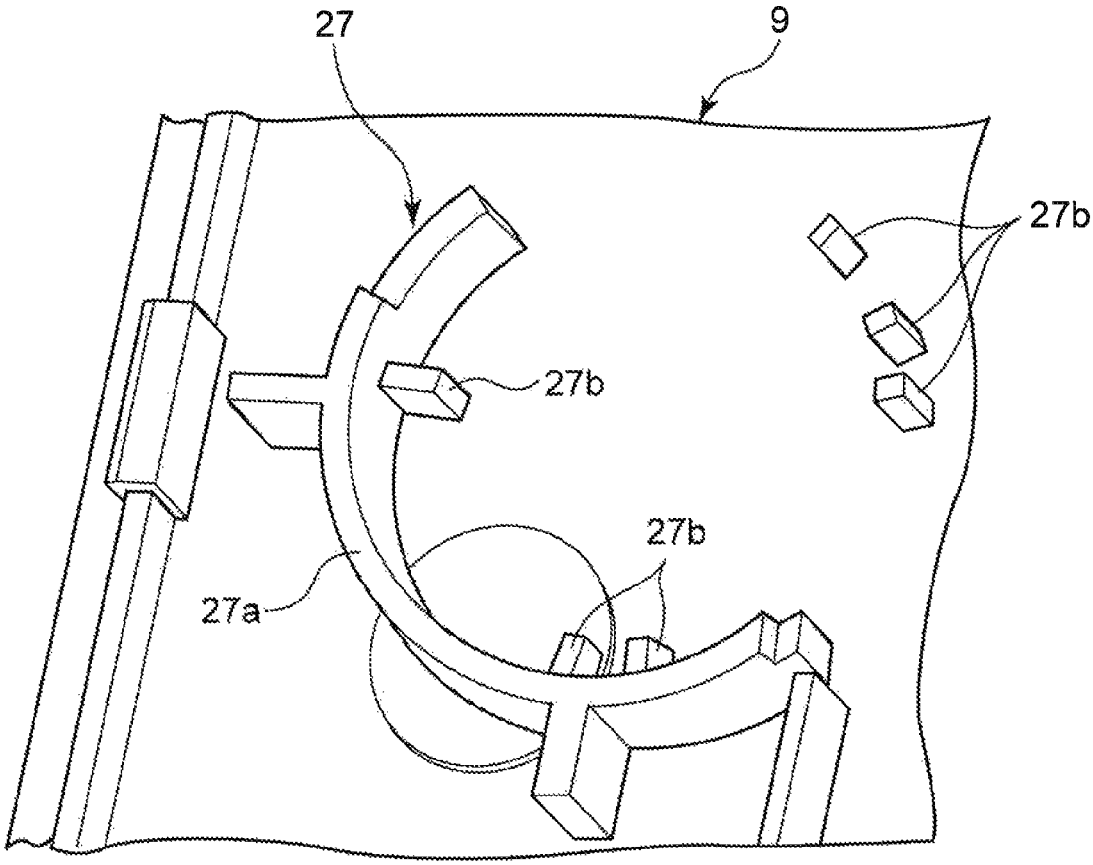
FIG. 13 is an enlarged perspective view of a speaker installing section in a lower case.

As shown in FIG. 3, an acoustic space 28 is formed below the speaker 16 by an acoustic wall section 27 provided in the lower case 9 of the first case 1. Specifically, the acoustic wall section 27 is constituted by a semi-circular arc-shaped wall section 27*a* that is provided upright on the bottom section of the lower case 9 and is in close contact with the lower outer periphery of the speaker attaching section 17, and a plurality of supporting columns 27*b* that are each provided upright on the bottom section of the lower case 9 and is in contact with the lower end surface of the speaker attaching section 17, as shown in FIG. 13. As a result, the acoustic wall section 27 is structured to form the acoustic space 28 that resonates sound emitted downwards from the speaker 16 within the overall lower case 9.

In addition, as shown in FIG. 2, two auxiliary key sections 30 and 31 are provided in areas on the outer periphery of the key top 18, such as an area between the 1 o' clock position and the 2 o' clock position, and an area between the 4 o' clock position and the 5 o'clock position. These two auxiliary key sections 30 and 31 are structured such that two contact sections 32 and 33 provided on the contact sheet 13 are inserted into two semi-circular holes 8*c* of FIG. 10 provided in the upper case 8 from below and exposed from the upper side, as shown in FIG. 5 and FIG. 11.

The contact sections 32 and 33 of the two auxiliary key sections 30 and 31 are structured by a movable contact (not shown) being provided in each of two projecting portions on the contact sheet 13. When the contact section 32 and 33 are pressed and elastically deformed, the movable contacts comes in contact with fixed contacts 32*a* and 33*a* provided on the lower substrate 10*b* shown in FIG. 4B, and a switch operation is performed thereby.

Next, the mounting of the speaker 16 into the speaker section 6 in the first case 1 will be described.

First, the contact sheet 13 is attached to the top surface of the circuit board 10 such that the contact sections 14 of the contact sheet 13 correspond to the respective fixed contacts 11*a* provided on the circuit board 10.

At this time, the speaker attaching section 17 of the contact sheet 13 is inserted into the insertion hole 19 in the circuit board 10 and projects lower than the circuit board 10. In this state, the outer peripheral edge of the circuit board 10 is fitted in the gripping section 15 provided on the outer peripheral edge of the contact sheet 13, whereby the contact sheet 13 is attached to the circuit board 10.

Next, the circuit board 10 to which the contact sheet 13 has been attached is placed in the upper case 8 of the first case 1. At this time, the assembler grasps the gripping section 15 of the contact sheet 13 positioned on the periphery of the circuit board 10, so that he can mount the circuit board 10 to the upper case 8 without touching it. Therefore, the circuit board 10 is not affected by static electricity or the like, and the quality thereof can be maintained.

In the mounting of the circuit board 10 to the upper case 8, the upper portions of the contact sections 14 of the contact sheet 13 is inserted into the respective key insertion holes 8*a* provided in the uppercase 8. In addition, the skirt section 24 of the speaker attaching section 17 and the plurality of contact sections 25 positioned around the outer periphery of the skirt section 24 are inserted into the circular hole 8*b* provided in the upper case 8.

Then, the key top 18 is attached to the upper portion of the skirt section 24 and the plurality of contact sections 25 positioned around the outer periphery of the skirt section 24 that have been inserted into the circular hole 8*b* of the upper case 8. At this time, the adhesive glue 26 is applied to the upper outer peripheral edge of the skirt section 24 and each top surface of the plurality of contact sections 25, by which the key top 18 is bonded, as shown in FIG. 11 and FIG. 12.

Next, the speaker 16 is inserted into the speaker attaching section 17 from below as shown in FIG. 14, such that the engaging projection 22 provided on the outer periphery of the speaker 16 corresponds to and engages with the engaging groove section 23 provided in the cylindrical section 20 of the speaker attaching section 17, as shown in FIG. 8 and FIG. 9.

In this state, the speaker 16 is press-fitted into the cylindrical section 20 from below, and the top surface of the outer peripheral portion of the speaker 16 comes in contact with the stopper section 21. As a result, the speaker 16 is fitted in the cylindrical section 20 of the speaker attaching section 17 without a gap being formed, as shown in FIG. 15.

Next, the speaker 16 is electrically connected to the circuit board 10 by the lead wire 16*a*, as shown in FIG. 6. At this time, because the speaker 16 has been fixed to the speaker attaching section 17, the lead wire 16*a* is not required to be fixed to the circuit board 10 by a fixing member, such as tape. As a result, the operation for connecting the speaker 16 and the circuit board 10 by the lead wire 16*a* is simplified, whereby the connection workability is improved.

Then, the lower case 9 is attached to the bottom of the upper case 8 such that the acoustic wall section 27 provided in the lower case 9 corresponds to the lower end surface of the cylindrical section 20 of the speaker attaching section 17, as shown in FIG. 3. As a result, the acoustic space 28 that widely occupies the interior of the lower case 9 is formed below the speaker 16 by the acoustic wall section 27.

Next, effects of this mounting structure for the speaker 16 will be described.

When the speaker 16 produces sound, this sound produced from the top surface side of the speaker 16 is emitted outside of the upper case 8 from the plurality of sound emitting holes 18*a* provided in the key top 18. At this time, because the speaker 16 has been press-fitted into the cylindrical section 20, the sound from the speaker 16 does not leak to the surrounding area, and chattering noise is not generated.

In addition, because the upper periphery of the speaker 16 is closed by the skirt section 24, the sound from the top surface side of the speaker 16 can be favorably and reliably emitted outside of the upper case 8 from the sound emitting holes 18*a* of the key top 18.

On the other hand, sound emitted from the bottom surface side of the speaker 16 is resonated in the acoustic space 28.

In the key operation of the key top 18, it is only required that any one of the areas corresponding to the 12 o'clock, 3 o'clock, 6 o'clock, and 9 o'clock positions of the key top 18 is pressed. When it is pressed, one of the plurality of contact sections 25 is depressed and elastically deformed, and the movable contact 25*b* of the contact section 25 comes in contact with the fixed contact 25*c* on the circuit board 10, whereby an ON operation is performed.

At this time, the skirt section 24 also elastically deforms, along with the elastic deformation of the contact section 25. Therefore, the key stroke of the plurality of contact sections 25 can be sufficiently secured by the skirt section 24, whereby the key operability is enhanced.

In the above-described embodiment, an instance is described in which the skirt section 24 is formed on the inner periphery of the stopper section 21 in the speaker attaching section 17 of the contact sheet 13. However, the skirt section 24 is not necessarily required to be formed on the inner periphery of the stopper section 21, and it may be formed in the upper portion of the cylindrical section 20 in the speaker attaching section 17.

Additionally, in the above-described embodiment, the mounting structure for the speaker 16 according to the present invention has been applied to an electronic dictionary. However, the mounting structure is not necessarily required to be applied to an electronic dictionary, and may be widely applied to various electronic devices, such as mobile phones and personal digital assistants (PDA).

While the present invention has been described with reference to the preferred embodiments, it is intended that the invention be not limited by any of the details of the description therein but includes all the embodiments which fall within the scope of the appended claims.

What is claimed is:

1. An electronic device comprising:

a case in which an opening section is provided in a predetermined area;

a circuit board arranged inside the case;

a speaker electrically connected to the circuit board; a contact sheet arranged on the circuit board, wherein (i) a speaker attaching section, which is vertically open with respect to the circuit board and into which the speaker is press-fitted, and (ii) a skirt section which extends upwards from the speaker attaching section, is elastically deformable, and whose upper portion is open, are integrally formed in the contact sheet in an area corresponding to the opening section in the case; and a key top having a sound emitting hole, the key top being provided on the upper portion of the skirt section;

wherein the circuit board is provided with an insertion hole, into which the speaker attaching section of the contact sheet is inserted, in the area corresponding to the opening section in the case, and a plurality of fixed contacts positioned at an outer periphery of the insertion hole;

wherein the contact sheet is provided with a plurality of movable contacts positioned at an outer periphery of the skirt section, and corresponding to the plurality of fixed contacts; and wherein the key top has a substantially planar shape and a size such that the key top covers the plurality of movable contacts.

2. The electronic device according to claim 1, wherein the speaker attaching section includes a cylindrical section which projects lower than the circuit board from an undersurface of the contact sheet through the insertion hole in the circuit board, and a stopper section which projects inward from an upper portion of the cylindrical section.

3. The electronic device according to claim 2, wherein the speaker has an engaging section provided on an outer periphery thereof, and the speaker attaching section has provided therein a locking section for positioning, with which the engaging section of the speaker engages.

4. The electronic device according to claim 1, wherein the case has provided therein an acoustic wall for forming an acoustic space below the speaker attaching section.

5. The electronic device according to claim 1, wherein the contact sheet has a gripping section provided on an outer peripheral edge thereof which grips an outer peripheral edge of the circuit board.

6. The electronic device according to claim 1, wherein a plurality of contact sections are provided, each contact section including one of the plurality of fixed contacts and a corresponding one of the plurality of movable contacts, wherein the plurality of contact sections are respectively placed at positions quartering an outer periphery of the speaker attaching section, and wherein the key top is operable as a switch for executing different functions of the electronic device depending on a pressed position.

7. The electronic device according to claim 6, wherein the key top is bonded to an upper portion of the skirt section and upper portions of the plurality of movable contacts by adhesive glue.

* * * * *